US011726424B2

(12) United States Patent
Suzuki et al.

(10) Patent No.: US 11,726,424 B2
(45) Date of Patent: Aug. 15, 2023

(54) IMAGE FORMING APPARATUS

(71) Applicant: BROTHER KOGYO KABUSHIKI KAISHA, Nagoya (JP)

(72) Inventors: Yasuhiro Suzuki, Nagoya (JP); Saya Minoshima, Gifu (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 320 days.

(21) Appl. No.: 17/201,566

(22) Filed: Mar. 15, 2021

(65) Prior Publication Data

US 2021/0294258 A1 Sep. 23, 2021

(30) Foreign Application Priority Data

Mar. 23, 2020 (JP) ..... 2020-051528

(51) Int. Cl.

| | |
|---|---|
| ***B65H 85/00*** | (2006.01) |
| ***G03G 15/00*** | (2006.01) |
| ***B65H 5/06*** | (2006.01) |
| ***B65H 29/58*** | (2006.01) |
| ***G03G 15/23*** | (2006.01) |

(52) U.S. Cl.

CPC ..... *G03G 15/6529* (2013.01); *B65H 5/062* (2013.01); *B65H 29/58* (2013.01); *B65H 85/00* (2013.01); *G03G 15/234* (2013.01); *B65H 2301/33312* (2013.01); *B65H 2404/632* (2013.01); *B65H 2801/06* (2013.01); *G03G 2215/00438* (2013.01); *G03G 2215/00586* (2013.01)

(58) Field of Classification Search

CPC ..... B65H 2301/33312; B65H 85/00; B65H 5/062; B65H 29/58; G03G 15/234; G03G 2215/00438; G03G 2215/00586; G03G 15/6529

See application file for complete search history.

(56) References Cited

U.S. PATENT DOCUMENTS 6,577,844 B2 * 6/2003 Kamei ..... G03G 15/234 399/301

FOREIGN PATENT DOCUMENTS

JP 2015-107871 A 6/2015

* cited by examiner

*Primary Examiner* — Jeremy R Severson
(74) *Attorney, Agent, or Firm* — Merchant & Gould P.C.

(57) ABSTRACT

In an image forming apparatus capable of turning over a sheet to form images on both sides of the sheet, when duplex printing is executed successively on three or more sheets, a controller causes a first sheet conveyed from an image forming unit and a second sheet conveyed from the image forming unit to be guided into a first path by positioning a guide member in a first position, and then conveyed into a third path by a first roller, and causes a third and subsequent sheets conveyed from the image forming unit to be guided into a second path by positioning the guide member in a second position, and then conveyed into the third path by a second roller.

10 Claims, 7 Drawing Sheets

FIG.6

Table A

| No. | Pagination | Second flapper position (initial position : first position) | Path chosen | Action | Jam detection flag (initial state : ON) |
|---|---|---|---|---|---|
| 1 | 2 | FIRST POSITION | FIRST PATH | REVERSE | OFF |
| 2 | 4 | FIRST POSITION | FIRST PATH | REVERSE | OFF |
| 1 | 1 | FIRST POSITION | FIRST PATH | EJECTION | ON |
| 2 | 3 | FIRST POSITION | FIRST PATH | EJECTION | ON |

Table B

| No. | Pagination | Second flapper position (initial position : first position) | Path chosen | Action | Jam detection flag (initial state : ON) |
|---|---|---|---|---|---|
| 1 | 2 | FIRST POSITION | FIRST PATH | REVERSE | OFF |
| 2 | 4 | FIRST POSITION | FIRST PATH | REVERSE | OFF |
| 3 | 6 | SECOND POSITION | SECOND PATH | REVERSE | ON |
| 1 | 1 | FIRST POSITION | FIRST PATH | EJECTION | ON |
| 2 | 3 | FIRST POSITION | FIRST PATH | EJECTION | ON |
| 3 | 5 | FIRST POSITION | FIRST PATH | EJECTION | ON |

Table C

| No. | Pagination | Second flapper position (initial position : first position) | Path chosen | Action | Jam detection flag (initial state : ON) |
|---|---|---|---|---|---|
| 1 | 2 | FIRST POSITION | FIRST PATH | REVERSE | OFF |
| 2 | 4 | FIRST POSITION | FIRST PATH | REVERSE | OFF |
| 3 | 6 | SECOND POSITION | SECOND PATH | REVERSE | ON |
| 1 | 1 | FIRST POSITION | FIRST PATH | EJECTION | ON |
| 4 | 8 | SECOND POSITION | SECOND PATH | REVERSE | ON |
| 2 | 3 | FIRST POSITION | FIRST PATH | EJECTION | ON |
| 3 | 5 | FIRST POSITION | FIRST PATH | EJECTION | ON |
| 4 | 7 | FIRST POSITION | FIRST PATH | EJECTION | ON |

FIG.7

Table D

| No. | Pagination | Second flapper position (initial position : first position) | Path chosen | Action | Jam detection flag (initial state : ON) |
|---|---|---|---|---|---|
| 1 | 2 | FIRST POSITION | FIRST PATH | REVERSE | OFF |
| 2 | 4 | FIRST POSITION | FIRST PATH | REVERSE | OFF |
| 3 | 6 | SECOND POSITION | SECOND PATH | REVERSE | ON |
| 1 | 1 | FIRST POSITION | FIRST PATH | EJECTION | ON |
| 4 | 8 | SECOND POSITION | SECOND PATH | REVERSE | ON |
| 2 | 3 | FIRST POSITION | FIRST PATH | EJECTION | ON |
| 5 | 10 | SECOND POSITION | SECOND PATH | REVERSE | ON |
| 3 | 5 | FIRST POSITION | FIRST PATH | EJECTION | ON |
| 4 | 7 | FIRST POSITION | FIRST PATH | EJECTION | ON |
| 5 | 9 | FIRST POSITION | FIRST PATH | EJECTION | ON |

Table E

| No. | Pagination | Second flapper position (initial position : first position) | Path chosen | Action | Jam detection flag (initial state : ON) |
|---|---|---|---|---|---|
| 1 | 2 | FIRST POSITION | FIRST PATH | REVERSE | OFF |
| 2 | 4 | FIRST POSITION | FIRST PATH | REVERSE | OFF |
| 3 | 6 | SECOND POSITION | SECOND PATH | REVERSE | ON |
| 1 | 1 | FIRST POSITION | FIRST PATH | EJECTION | ON |
| 4 | 8 | SECOND POSITION | SECOND PATH | REVERSE | ON |
| 2 | 3 | FIRST POSITION | FIRST PATH | EJECTION | ON |
| 5 | 10 | SECOND POSITION | SECOND PATH | REVERSE | ON |
| ⋮ | ⋮ | ⋮ | ⋮ | ⋮ | ⋮ |
| N-3 | ODD NUMBER | FIRST POSITION | FIRST PATH | EJECTION | ON |
| N | EVEN NUMBER | SECOND POSITION | SECOND PATH | REVERSE | ON |
| N-2 | ODD NUMBER | FIRST POSITION | FIRST PATH | EJECTION | ON |
| N-1 | ODD NUMBER | FIRST POSITION | FIRST PATH | EJECTION | ON |
| N | ODD NUMBER | FIRST POSITION | FIRST PATH | EJECTION | ON |

IMAGE FORMING APPARATUS

CROSS-REFERENCE TO RELATED APPLICATION(S)

This application claims priority from Japanese Patent Application No. 2020-051528 filed on Mar. 23, 2020, the disclosure of which is incorporated herein by reference in its entirety.

TECHNICAL FIELD

Apparatuses disclosed herein relate to an image forming apparatus having duplexing capabilities, more particularly to an image forming apparatus capable of turning over a sheet to form images on both sides of the sheet.

BACKGROUND ART

Image forming apparatuses capable of turning over a sheet to form images on both sides of the sheet are known in the art. One example of such image forming apparatuses comprises an image forming unit, a first conveyor path, a second conveyor path, a first reversing means, a second reversing means, and a flapper. The image forming unit is configured to form an image on either side of a sheet. The first conveyor path is configured to guide a sheet to form an image thereon. The second conveyor path is a path branching off from the first conveyor path and configured to convey, to the image forming unit again, the sheet having an image formed on one side thereof. The first reversing means is configured to reverse a sheet conveyed from the first conveyor path and feed the same to the second conveyor path to form an image on the other side of the sheet. The second reversing means is configured to be capable of ejecting a sheet conveyed from the first conveyor path to the outside of the apparatus as well as reversing a sheet conveyed from the first conveyor path and feeding the same to the second conveyor path to form an image on the other side of the sheet. The flapper is configured to guide a sheet selectively either to the first reversing means or to the second reversing means.

With this configuration, when images are formed on both sides of two sheets, the first sheet is guided by the flapper to the first reversing means, reversed by the first reversing means and conveyed into the second conveyor path, and the flapper is then moved so that the second sheet is guided by the flapper to the second reversing means, reversed by the second reversing means and conveyed into the second conveyor path.

SUMMARY

The above-described configuration shall allot an appreciable amount of time for which one sheet being reversed occupies a path for ejecting the other sheet, and thus places the limitations on throughput of continuous double-sided image forming operations. In addition, the operation noise of the flapper moved after reversing the first sheet to reverse the second sheet would unavoidably occur.

There is a need to provide an image forming apparatus in which the throughput of continuous double-sided image forming operations can be increased.

In one aspect, an image forming apparatus capable of turning over a sheet to form images on both sides of the sheet is disclosed herein, which comprises an image forming unit, a first path, a second path, a third path, a guide member, a first roller, a second roller, and a controller. The image forming unit is configured to form an image on a sheet. The first path is configured to guide the sheet conveyed from the image forming unit toward outside of the image forming apparatus. The second path branching off from the first path is configured to guide the sheet conveyed from the image forming unit. The third path is connected to the first path and the second path, and configured to guide the sheet conveyed from the first path or the second path toward the image forming unit again. The guide member is movable between a first position in which to guide the sheet conveyed from the image forming unit into the first path and a second position in which to guide the sheet conveyed from the image forming unit into the second path. The first roller is configured to convey the sheet guided into the first path forward toward the outside of the image forming apparatus, and backward into the third path to turn over the sheet. The second roller is configured to convey the sheet guided into the second path forward, and backward into the third path to turn over the sheet. When duplex printing is executed successively on three or more sheets, the controller causes a first sheet conveyed from the image forming unit and a second sheet conveyed from the image forming unit to be guided into the first path by positioning the guide member in the first position, and then conveyed into the third path by the first roller; and causes a third and subsequent sheets conveyed from the image forming unit to be guided into the second path by positioning the guide member in the second position, and then conveyed into the third path by the second roller.

BRIEF DESCRIPTION OF THE DRAWINGS

The above and other aspects, their advantages and further features will become more apparent by describing in detail illustrative, non-limiting embodiments thereof with reference to the accompanying drawings, in which:

FIG. 6 shows tables A, B and C for explaining a process of conveyance of two, three and four sheets, respectively, as followed when duplex printing is executed successively, in which shown for each side of the sheets are: the ordinal number of the sheets, pagination, the position of the second flapper, the path into which the sheet is guided by the second flapper, action type, and jam detection flag status; and FIG. 7 shows tables D and E for explaining a process of conveyance of five, and more than five sheets, respectively, as followed when duplex printing is executed successively, in which shown for each side of the sheets are: the ordinal number of the sheets, pagination, the position of the second flapper, the path into which the sheet is guided by the second flapper, action type, and jam detection flag status.

DESCRIPTION OF EMBODIMENTS

Figure 1:
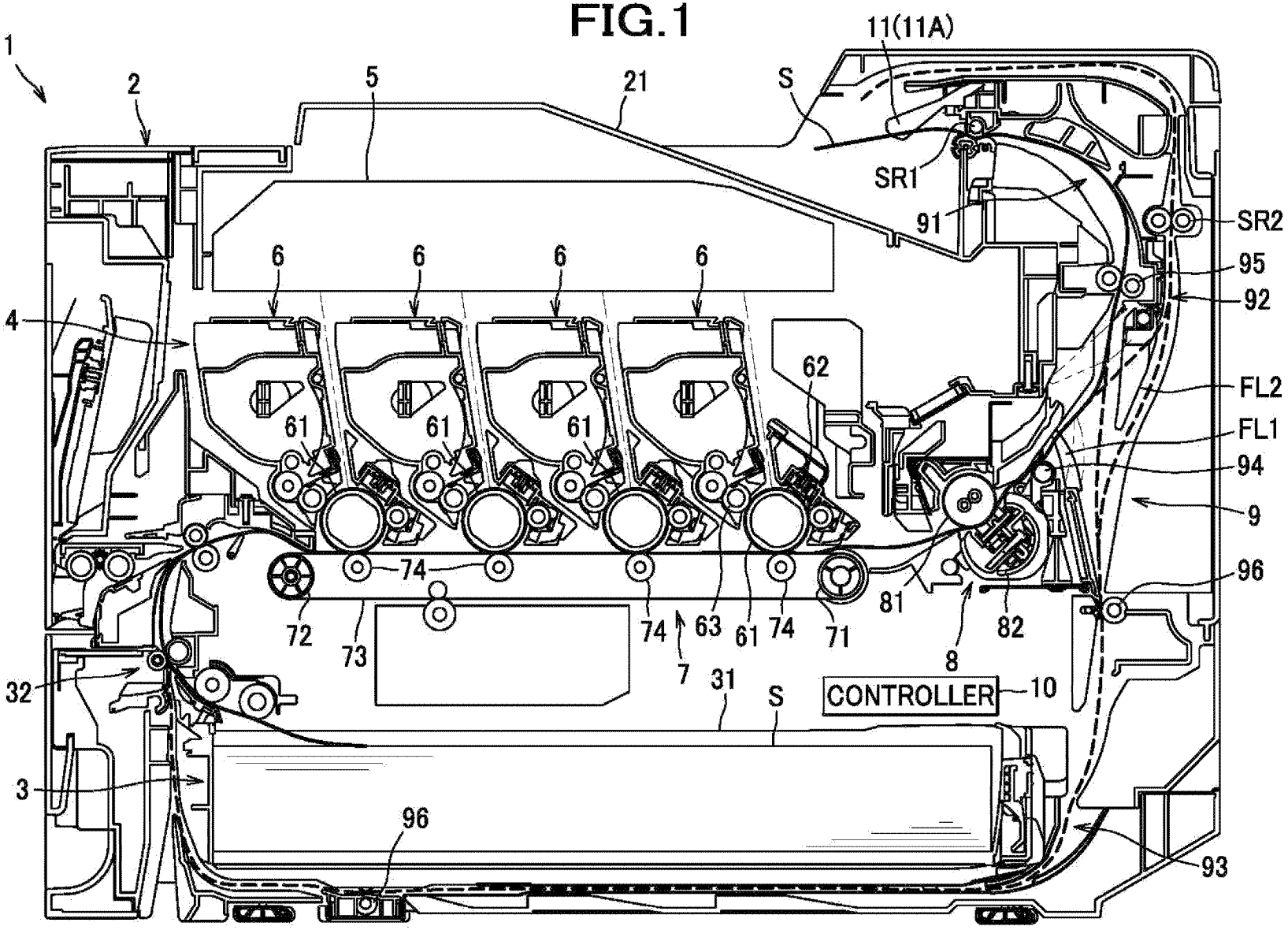
FIG. 1 is a section view of an image forming apparatus.

As shown in FIG. 1, an image forming apparatus 1 illustrated herein is configured as a duplex printer capable of turning over a sheet S to form images on both sides of the sheet S. The image forming apparatus 1 comprises a housing 2, and several components housed in the housing 2, which include a feeder unit 3, an image forming unit 4, a conveyor unit 9, and a controller 10. The housing 2 comprises an output tray 21. The output tray 21 is provided on a top surface of the housing 2. The output tray 21 is configured to support a sheet S ejected out of the apparatus 1, specifically, from the housing 2, by a first switchback roller SR1 which will be described later. The output tray 21 is capable of receiving and supporting one or more sheets S ejected out from the housing 2 by the first switchback roller SR1 and stacked on top of each other.

The feeder unit 3 is provided in a lower space within the housing 2, and comprises a sheet feed tray 31 and a sheet feed mechanism 32. The sheet feed tray 31 is configured to hold sheets S. The sheet feed mechanism 32 is configured to feed a sheet S held in the sheet feed tray 31 or a sheet S guided along a third path 93 which will be described later, into the image forming unit 4.

The image forming unit 4 is configured to transfer toner images and form an image on a sheet S. The image forming unit 4 comprises an exposure device 5, four process units 6, a transfer unit 7, and a fixing device 8.

The exposure device 5 is disposed in an upper space within the housing 2, and comprises a light source, polygon mirror, and other components (not shown). The exposure device 5 is configured to emit a plurality of light beams indicated by alternate long and short dashed lines, each of the light beams being directed to a photoconductor drum 61 in a corresponding process unit 6 so that a surface of each photoconductor drum 61 is rapidly scanned with and exposed to the corresponding light beam.

The process units 6 are disposed between the exposure device 5 and the sheet feed tray 31. Each process unit 6 comprises a photoconductor drum 61, a charger 62, and a development roller 63. In these four process units 6, toners of different colors, i.e., yellow, magenta, cyan and black, are contained, respectively.

The transfer unit 7 is disposed between the process units 6 and the sheet feed tray 31. The transfer unit 7 comprises a drive roller 71, a follower roller 72, a conveyor belt 73, and four transfer rollers 74. The conveyor belt 73 is an endless belt looped around and run between the drive roller 71 and the follower roller 72. The transfer rollers 74 are located inside the conveyor belt 73, and so arranged that the conveyor belt 73 is held between each transfer roller 74 and the corresponding photoconductor drum 61.

Each of the chargers 62 charges the surface of the corresponding photoconductor drum 61. Thereafter, the exposure device 5 individually exposes the surface of each photoconductor drum 61 to light, so that an individual electrostatic latent image formulated based on image data is formed on the surface of the corresponding photoconductor drum 61. Each of the development rollers 63 supplies toner to the electrostatic latent image formed on the surface of the corresponding photoconductor drum 61. In this way, a toner image is formed on each photoconductor drum 61. Subsequently, a sheet S is conveyed on the conveyor belt 73 and caused to pass through between each photoconductor drum 61 and the corresponding transfer roller 74, so that the toner images on the photoconductor drums 61 are transferred onto the sheet S.

The fixing device 8 is a device configured to thermally fix a toner image on a sheet S. The fixing device 8 is disposed rearward of the process units 6 and the transfer unit 7. The fixing device 8 includes a heating roller 81 and a pressure member 82 which are so located that a sheet S is held between the heating roller 81 and the pressure member 82.

The conveyor unit 9 is configured to convey a sheet S conveyed from the image forming unit 4 either toward outside of the housing 2 or toward the image forming unit 4 again. The conveyor unit 9 comprises a first path 91, a second path 92, a third path 93, a first conveyor roller 94, a second conveyor roller 95, a first switchback roller SR1, a second switchback roller SR2, a plurality of re-conveyor rollers 96, a first flapper FL1, and a second flapper FL2. The second flapper FL is an example of the guide member.

The first path 91 is configured to guide a sheet S conveyed from the image forming unit 4 toward the output tray 21 outside the housing 2. The first path 91 extends from a position near the first conveyor roller 94 upward, and curves frontward, i.e., toward the output tray 21 outside the housing 2.

The second path 92 is configured to provide a different route through which to guide a sheet S conveyed from the image forming unit 4 toward the output tray 21. The second path 92 branches off from the first path 91 at a position near the second flapper FL2, extends upward along a rear side of the first path 91, curves frontward, and further extends along an upper side of the first path 91, i.e., toward the output tray 21. The second path 92 is located closer, than the first path 91, to the outside of the housing 2.

The third path 93 is configured to guide a sheet S drawn in the housing 2 by the rollers (the first switchback roller SR1 and the second conveyor roller 95, or the second switchback roller SR2) which will be described later, toward the image forming unit 4 again. The third path 93 is connected to the first path 91 and the second path 92. To be more specific, the third path 93 is configured to guide the sheet S to the sheet feed mechanism 32 provided upstream of the image forming unit 4. The third path 93 extends from a position near the second flapper FL2 downward, curves frontward, extends frontward along an under side of the sheet feed tray 31, and curves at a front side of the sheet feed tray 31 upward, i.e., toward the sheet feed mechanism 32.

The first conveyor roller 94 is provided on the fixing device 8. The first conveyor roller 94 is configured to convey a sheet S with a toner image thermally fixed thereon, toward the second flapper FL2.

The second conveyor roller 95 and the first switchback roller SR1 are configured as an example of the first roller, and provided in the first path 91. The first switchback roller SR1 is located closer, than the second conveyor roller 95, to the output tray 21 along the first path 91. The second switchback roller SR2 is configured as an example of the second roller, and provided in the second path 92.

The second conveyor roller 95 and the first switchback roller SR1 are configured to convey a sheet S guided into the first path 91 forward toward the outside of the housing 2, and if the sheet S is to be subjected to duplex printing, backward into the third path 93 to turn over the sheet S. The second switchback roller SR2 is configured to convey the sheet S guided into the second path 92 forward, and if the sheet S is to be subjected to duplex printing, backward into the third path 93 to turn over the sheet S.

To be more specific, the second conveyor roller 95, the first switchback roller SR1 and the second switchback roller SR2 are configured as rollers capable of rotating in normal and reverse directions. The second conveyor roller 95 and the first switchback roller SR1 rotate in the normal direction so that a sheet S in the first path 91 is conveyed forward toward the outside of the housing 2, specifically, toward the output tray 21, and rotate in the reverse direction so that the sheet S is drawn back into the housing 2 and conveyed into the third path 93. The second switchback roller SR2 rotates in the normal direction so that a sheet S in the second path 92 is conveyed forward toward the output tray 21, and rotates in the reverse direction so that the sheet S is drawn back into the housing 2 and conveyed into the third path 93.

The re-conveyor rollers 96 are provided in the third path 93. The re-conveyor rollers 96 are configured to convey a sheet S in the third path 93 toward the sheet feed mechanism 32.

The first flapper FL1 is configured to be swingable between a third position indicated by a chain double-dashed line and a fourth position indicated by a solid line. The first flapper FL1 in the third position guides a sheet conveyed from the image forming unit 4 toward the second flapper FL2. The first flapper FL1 in the fourth position serves to prevent a sheet S drawn into the housing 2 by the first switchback roller SR1 and the second conveyor roller 95, or the second switchback roller SR2, from going toward the fixing device 8.

The first flapper FL1 is biased toward the fourth position by a spring (not shown). A sheet S conveyed from the image forming unit 4 pushes the first flapper FL1 against a biasing force of the spring and causes the first flapper FL1 to swing from the fourth position to the third position. When the trailing edge of the sheet S comes off the first flapper FL1, the first flapper FL1 is caused to swing from the third position to the fourth position by the biasing force of the spring.

The second flapper FL2 is a member configured to selectively guide a sheet S conveyed from the image forming unit 4 either into the first path 91 or into the second path 92. The second flapper FL2 is configured to be movable between a first position indicated by a solid line and a second position indicated by a chain double-dashed line. The second flapper FL2 in the first position guides a sheet S conveyed from the image forming unit 4 into the first path 91. The second flapper FL2 in the second position guides a sheet S conveyed from the image forming unit 4 into the second path 92.

Figure 2A:
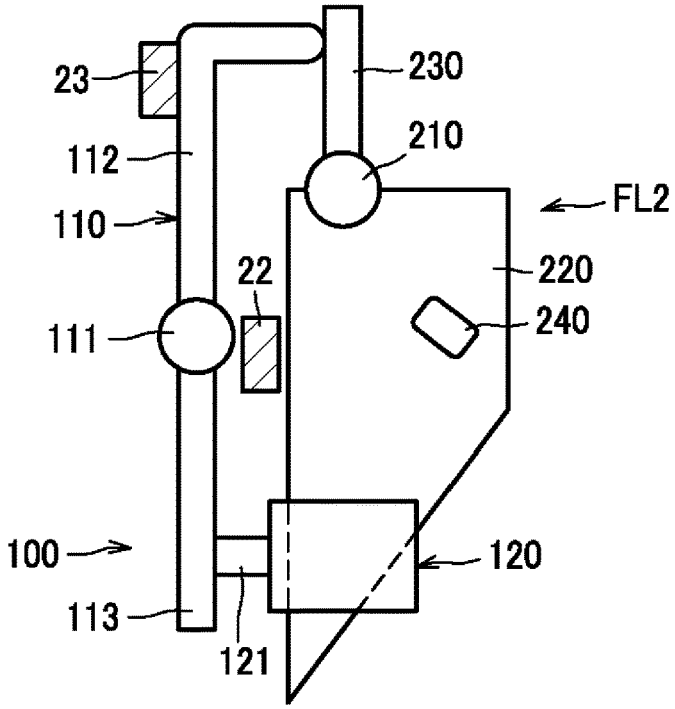
FIGS. 2A and 2B are schematic diagrams showing arrangement and operation of a second flapper, an actuator mechanism, a first stopper and a second stopper.
Figure 2B:
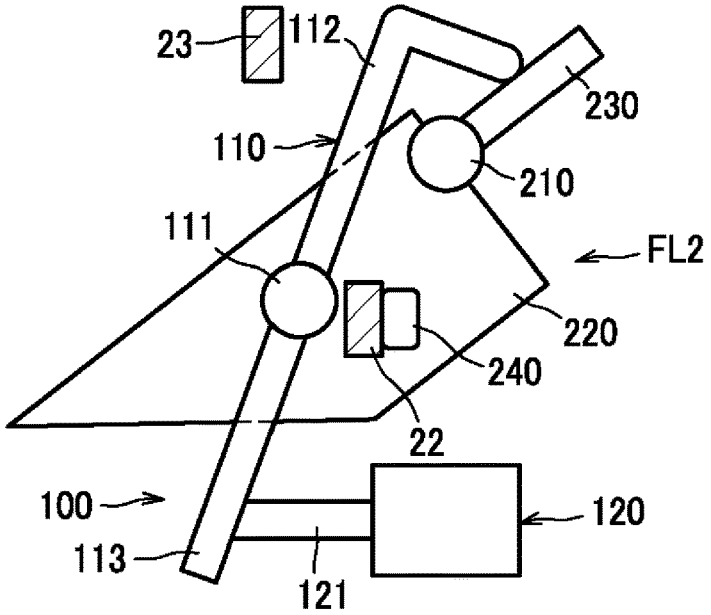

The second flapper FL2 is configured, for example as shown in FIGS. 2A and 2B, and comprises a shaft 210, a flapper body 220, an operation lever 230, and a contact block 240. The flapper body 220 is configured to guide a sheet S. The shaft 210 is provided at an upper portion of the flapper body 220. The operation lever 230 extends from the shaft 210 in a direction away from the flapper body 220. The second flapper FL2 is supported, swingably relative to the housing 2 between the first position shown in FIG. 2A and the second position shown in FIG. 2B, on the shaft 210, i.e., on a pivot located at an upper portion of the second flapper FL2. The second flapper FL2 moves from the second position to the first position by gravity. The second flapper FL2 moves from the first position to the second position by an actuator mechanism 100 provided in the image forming apparatus 1. The actuator mechanism 100 comprises an actuator lever 110 and a solenoid 120. The actuator lever 110 is an example of a member configured to actuate the second flapper FL2. The solenoid 120 is an electromechanical solenoid configured to cause the actuator lever 110 to move.

The actuator lever 110 comprises a shaft 111, a first arm 112, and a second arm 113. The shaft 111 is supported rotatably relative to the housing 2. The first arm 112 and the second arm 113 extend from the shaft 111 in mutually opposite directions. The first arm 112 is bent toward the operation lever 230, so that an end of the first arm 112 contacts the operation lever 230. The actuator lever 110 is configured to be swingable on the shaft 111 between a fifth position shown in FIG. 2A and a sixth position shown in FIG. 2B.

The solenoid 120 comprises a plunger 121. An end of the plunger 121 is connected to the second arm 113. When the solenoid 120 is turned on (energized), the plunger 121 pushes the second arm 113 and causes the actuator lever 110 to swing from the fifth position to the sixth position as shown in FIG. 2B. When the solenoid 120 is turned off (de-energized), the plunger 121 pulls the second arm 113 and causes the actuator lever 110 to swing from the sixth position to the fifth position as shown in FIG. 2A.

When the second flapper FL2 is in an initial state as assumed when the image forming apparatus 1 is in a standby mode and is waiting for entry of a printing instruction, the second flapper FL2 is in the first position shown in FIG. 2A. When duplex printing is executed successively on three or more sheets S, the second flapper FL2 swings between the first position and the second position under on-off control exercised over the solenoid 120 by the controller 10.

To be more specific, the second flapper FL2 is caused to swing from the first position to the second position by the first arm 112 pushing the operation lever 230 when the solenoid 120 is turned on to cause the actuator lever 110 to swing from the fifth position shown in FIG. 2A to the sixth position shown in FIG. 2B. Conversely, when the solenoid 120 is turned off to cause the actuator lever 110 to swing from the sixth position to the fifth position, the second flapper FL2 is caused to swing from the second position to the first position by gravity in accordance with the swinging motion of the actuator lever 110.

The image forming apparatus 1 further comprises a first stopper 22 and a second stopper 23.

As shown in FIG. 2B, the first stopper 22 is a part with which the contact block 240 provided in the second flapper FL2 comes in contact when the second flapper FL2 is in the second position, as shown in FIG. 2B. The first stopper 22 provided herein serves to prevent the second flapper FL2 from swinging excessively from the second position further in the clockwise direction in FIG. 2B.

The second stopper 23 is a part with which the first arm 112 of the actuator lever 110 is in contact when the second flapper FL2 is in the first position, as shown in FIG. 2A. The second stopper 23 provided herein serves to prevent the actuator lever 110 from swinging excessively from the fifth position further in the counterclockwise direction in FIG. 2A. The actuator lever 110 thus retained in the fifth position serves to prevent the second flapper FL2 from swinging excessively from the first position further in the counterclockwise direction in FIG. 2A.

As shown in FIG. 1, the image forming apparatus 1 further comprises a detector 11. The detector 11 is configured to detect a sheet S which is being conveyed on a way out onto the output tray 21 by the first switchback roller SR1. To be more specific, the detector 11 includes a swing lever 11A configured to make a swinging motion caused by being pushed by a sheet S on its way to the output tray 21, and an optical sensor (not shown) configured to detect the swinging motion of the swing lever 11A. One example of such a detector 11 may be configured to output an ON signal to the controller 10 when the swing lever 11A swings, and to output an OFF signal to the controller 10 when the swing lever 11A is at rest without swinging.

In the illustrated image forming apparatus 1, the second path 92 is routed above the detector 11 (swing lever 11A) and extends toward the output tray 21. Therefore, the detector 11 does not detect a sheet S which is being conveyed on a way out onto the output tray 21 by the second switchback roller SR2.

The controller 10 is configured such that a determination that a jam of a sheet S has occurred is made on condition that detection of the sheet S by the detector 11 continues for a predetermined or longer duration of time. To be more specific, the controller 10 is configured such that a determination that a sheet S has got jammed (i.e., a sheet jam has occurred) is made on condition that the detector 11 continuously outputs an ON signal for a predetermined or longer duration of time. If the controller 10 makes a determination that a sheet jam has occurred, then the controller 10 stops the printing process and notifies a user to that effect.

The controller 10 is an electronic device that controls the operation of the image forming apparatus 1. The controller 10 includes a central processing unit (CPU), a read-only memory (ROM), a random-access memory (RAM), an input/output device, and other elements, and is configured to execute various processes by running one or more of program modules provided in advance. The controller 10 is capable of executing a printing process to form an image on a sheet S in response to a printing instruction. The controller 10 is also capable of executing a process of duplex printing to form images on both sides of a sheet S in accordance with an instruction of duplex printing.

When duplex printing is executed successively on three or more sheets S, the controller 10 causes a first sheet S conveyed from the image forming unit 4 and a second sheet S conveyed from the image forming unit 4 to be guided into the first path 91 by positioning the second flapper FL2 in the first position, and then conveyed into the third path 93 by the second conveyor roller 95 and the first switchback roller SR1.

When duplex printing is executed successively on three or more sheets S, the controller 10 causes a third and subsequent sheets S conveyed from the image forming unit 4 to be guided into the second path 92 by positioning the second flapper FL2 in the second position, and then conveyed into the third path 93 by the second switchback roller SR2.

Figure 3A:
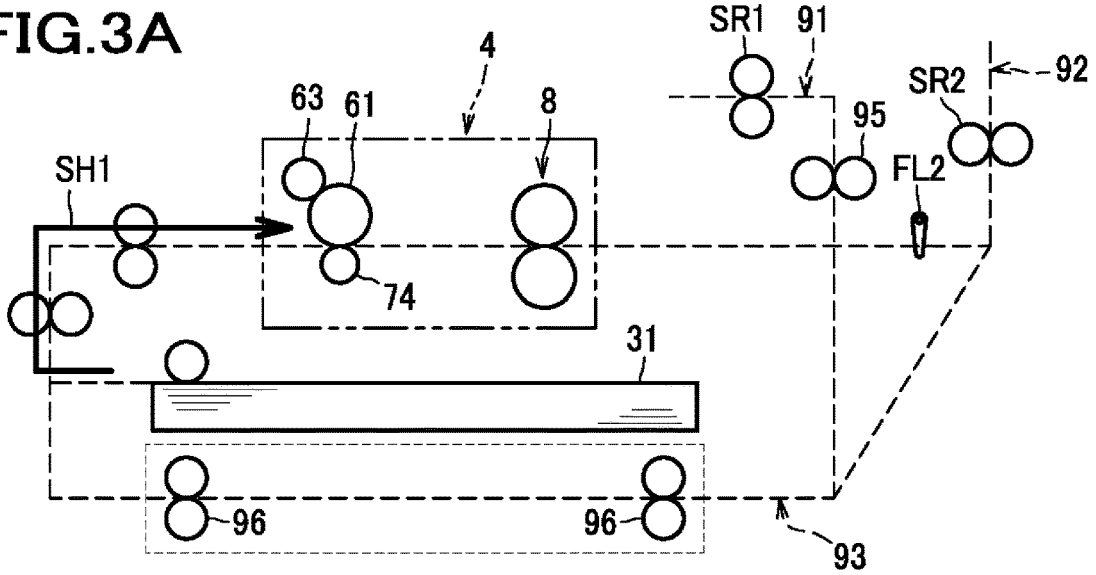
FIGS. 3A, 3B and 3C are schematic diagrams showing a change in the state of conveyance of sheets taking place when duplex printing is executed successively, after conveyance of a first sheet is started until conveyance of a second sheet is started.
Figure 3B:
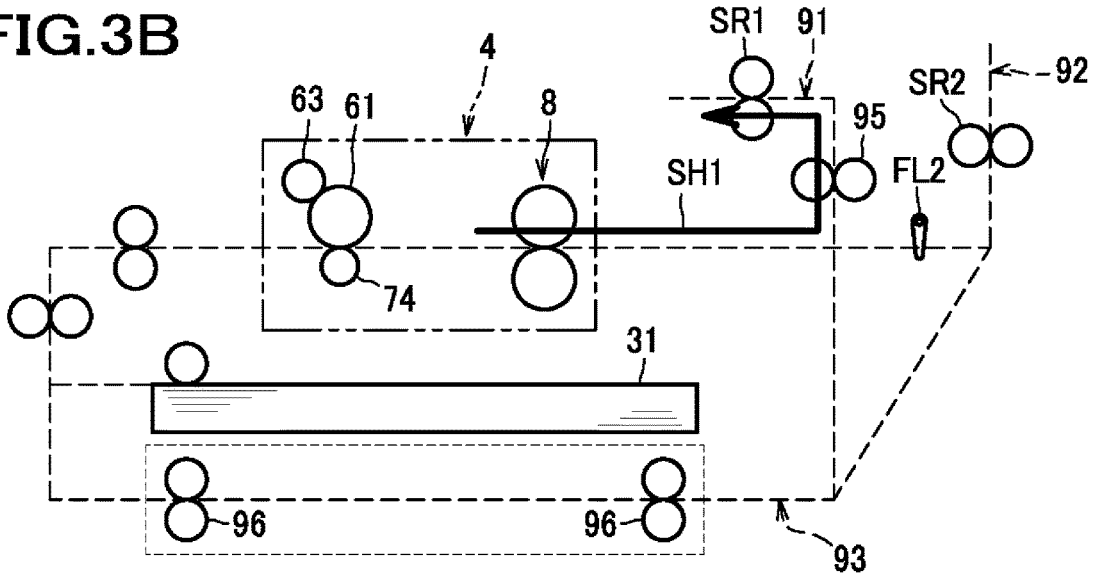

For example, when duplex printing is executed successively on four sheets S, the controller 10 exercises control, as shown in FIGS. 3A and 3B, such that after an image is formed on a first side of a first sheet SH1 picked up from the sheet feed tray 31, the sheet SH1 is conveyed from the image forming unit 4 and guided into the first path 91 by the second flapper FL2 retained in the first position that is the initial position. Then, the controller 10 causes the second conveyor roller 95 and the first switchback roller SR1 to rotate in the normal direction so as to convey the sheet SH1 forward toward the outside of the housing 2.

Figure 3C:
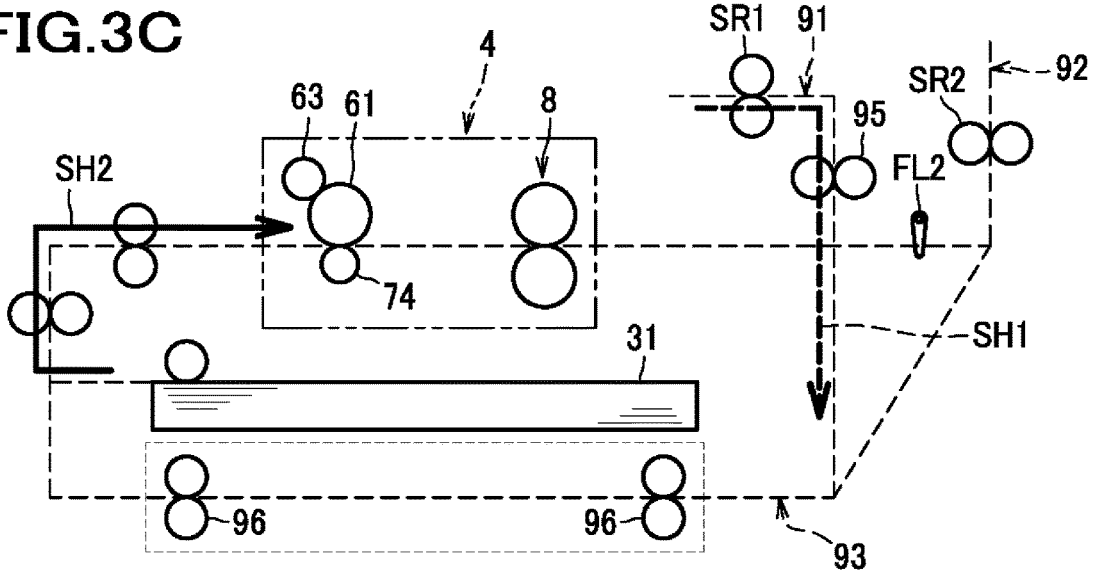

Thereafter, the controller 10 causes the second conveyor roller 95 and the first switchback roller SR1 to temporarily stop rotating and then rotate in the reverse direction so as to convey the sheet SH1 backward into the third path 93, as shown in FIG. 3C.

It is to be understood that in FIGS. 3 to 5, the sheet S indicated by a broken line represents a sheet S after switchback by the second conveyor roller 95 and the first switchback roller SR1 or the second switchback roller SR2, and the sheet S indicated by a solid line represents a sheet S before the switchback.

Figure 4A:
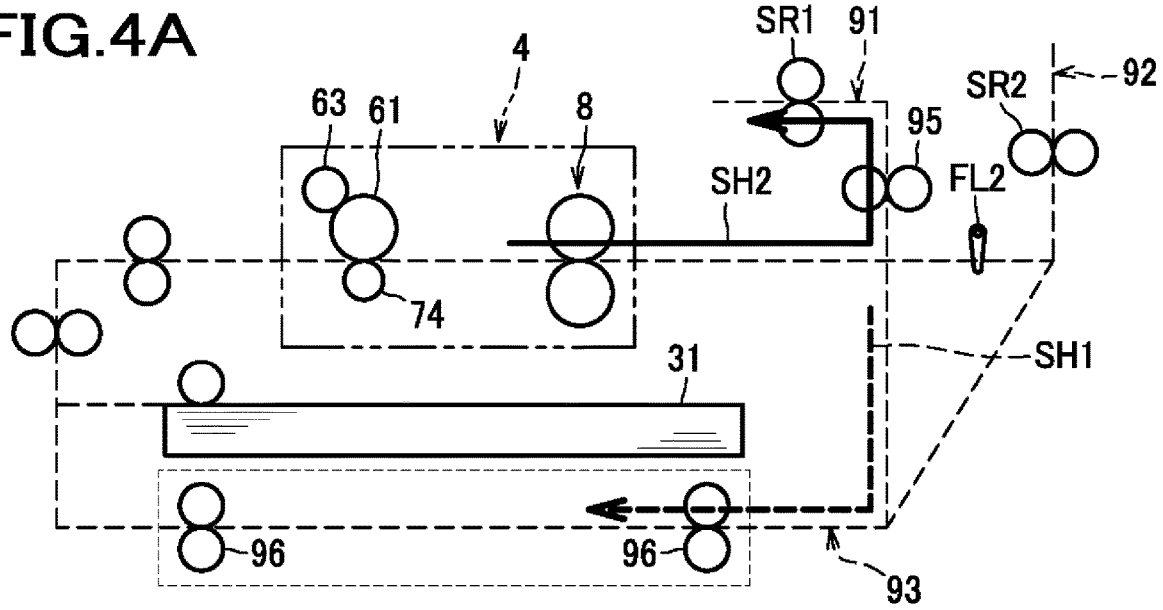
FIGS. 4A and 4B are schematic diagrams showing a change in the state of conveyance of sheets after an image is formed on a first side of the second sheet until conveyance of a third sheet is started.
Figure 4B:
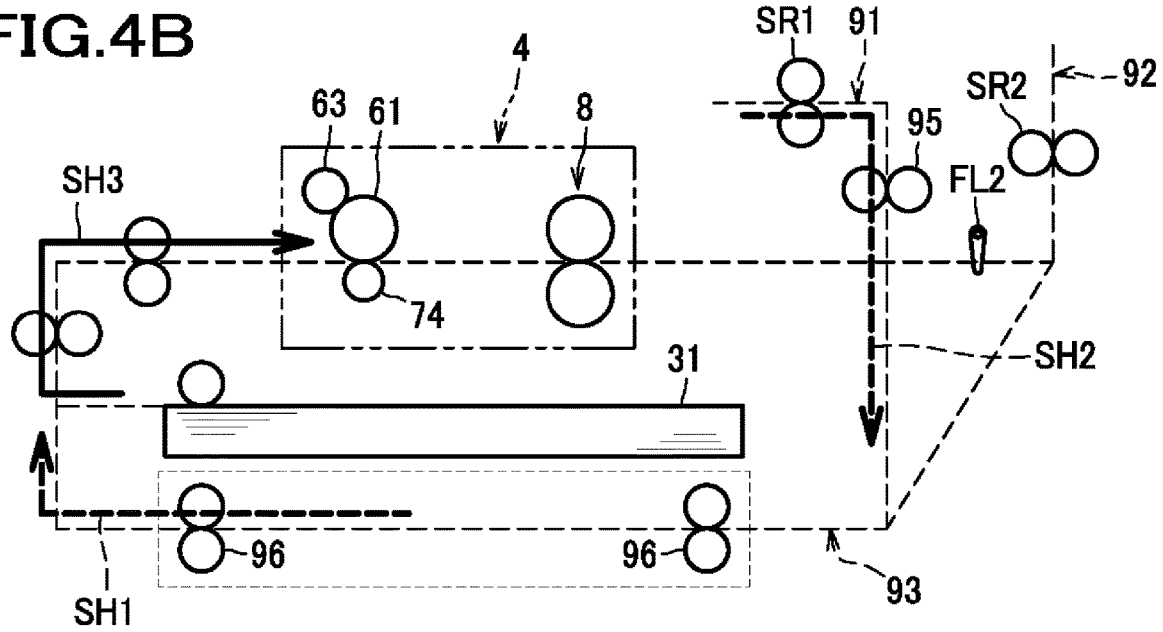

Then, as shown in FIG. 3C, the controller 10 exercises control such that a second sheet SH2 is picked up from the sheet feed tray 31 and conveyed to the image forming unit 4. Thereafter, as shown in FIG. 4A, the controller 10 causes the re-conveyor rollers 96 to rotate and convey the sheet SH1 in the third path 93, and simultaneously causes the image forming unit 4 to form an image on a first side of the second sheet SH2, and causes the sheet SH2 conveyed from the image forming unit 4 to be guided into the first path 91 by the second flapper FL2 retained in the first position, and causes the second conveyor roller 95 and the first switchback roller SR1 to rotate in the normal direction so as to convey the sheet SH2 forward toward the outside of the housing 2. Thereafter, as shown in FIG. 4B, the controller 10 causes the re-conveyor rollers 96 to rotate and convey the first sheet SH1 in the third path 93, and simultaneously, causes the second conveyor roller 95 and the first switchback roller SR1 to rotate in the reverse direction so as to convey the second sheet SH2 into the third path 93. Then, the controller 10 exercises control such that a third sheet SH3 is picked up from the sheet feed tray 31 and fed into a conveyance path to the image forming unit 4 in time so that the third sheet SH3 runs forward (i.e., downstream in the direction of conveyance) of the first sheet SH1. The controller 10 then causes the image forming unit 4 to form an image on a first side of the third sheet SH3.

Figure 5A:
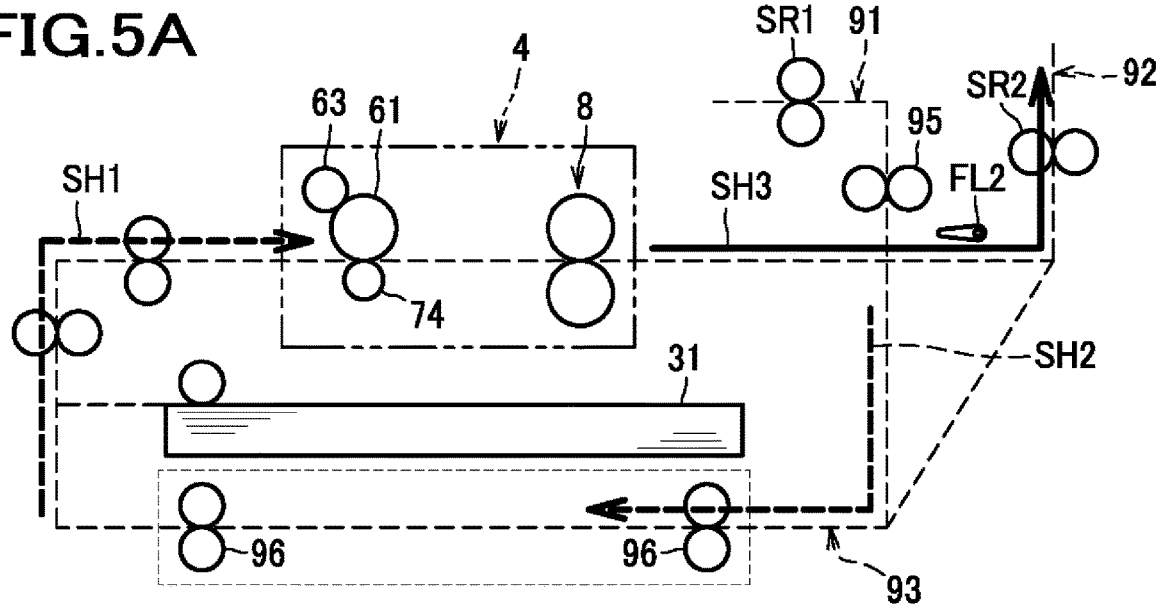
FIGS. 5A and 5B are schematic diagrams showing a change in the state of conveyance of sheets after an image is formed on a first side of the third sheet until conveyance of a fourth sheet is started.

Thereafter, as shown in FIG. 5A, the controller 10 causes the second flapper FL2 to swing from the first position to the second position. The controller 10 causes the third sheet SH3 having an image formed on the first side thereof and conveyed from the image forming unit 4 to be guided into the second path 92 by the second flapper FL2 in the second position. The controller 10 then causes the second switchback roller SR2 to rotate in the normal direction so as to convey the third sheet SH3 forward toward the outside of the housing 2.

Figure 5B:
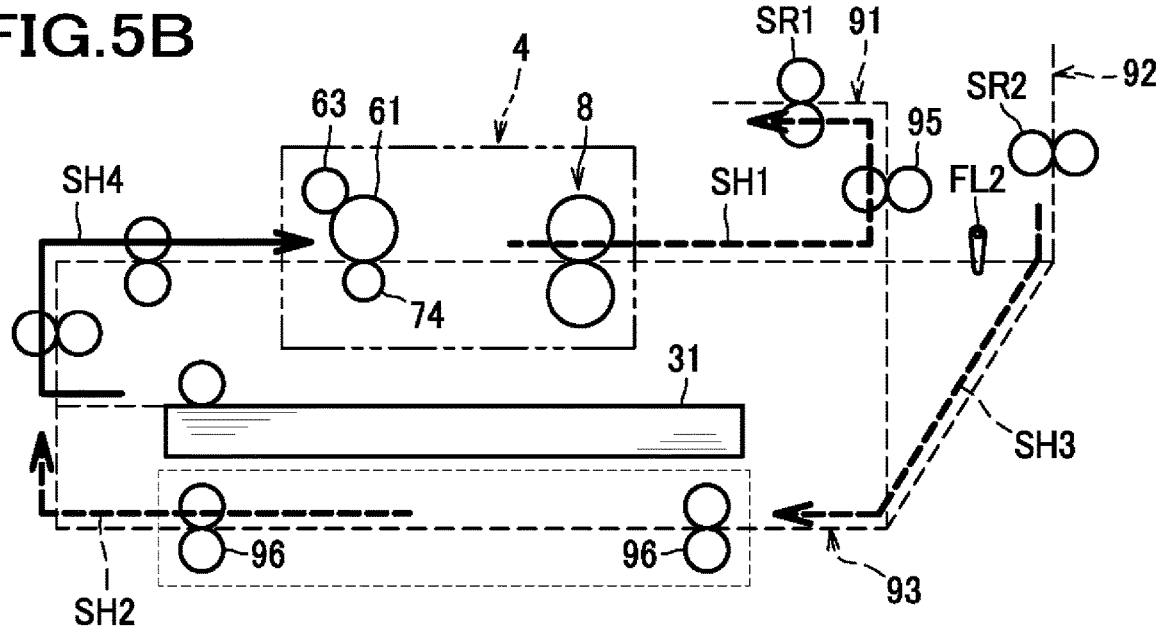

Thereafter, as shown in FIG. 5B, the controller 10 causes the second flapper FL2 to swing from the second position to the first position. The controller 10 then causes the second switchback roller SR2 to temporarily stop rotating and then rotate in the reverse direction so as to convey the third sheet SH3 backward into the third path 93.

Meanwhile, the controller 10 causes the image forming unit 4 to form an image on a second side of the first sheet SH1. The controller 10 causes the first sheet SH1 with images formed on both sides thereof to be guided into the first path 91 by the second flapper FL2 in the first position, and causes the second conveyor roller 95 and the first switchback roller SR1 to rotate in the normal direction, so that the first sheet SH1 is conveyed and ejected out onto the output tray 21 by the second conveyor roller 95 and the first switchback roller SR1.

Besides, the controller 10 also exercises control such that a fourth sheet SH4 is picked up from the sheet feed tray 31 and fed into a conveyance path to the image forming unit 4 in time so that the fourth sheet SH4 is conveyed between the first sheet SH1 and the second sheet SH2. Subsequently, after the trailing edge of the first sheet SH1 to be ejected goes past the second flapper FL2, the controller 10 causes the second flapper FL2 to swing from the first position to the second position, and causes the fourth sheet SH4 having an image formed on a first side thereof and conveyed from the image forming unit 4 to be guided into the second path 92 by the second flapper FL2 in the second position.

Thereafter, after the trailing edge of the fourth sheet SH4 goes past the second flapper FL2, the controller 10 causes the second flapper FL2 to swing from the second position to the first position, and causes the second switchback roller SR2 to rotate in the reverse direction so as to convey the fourth sheet SH4 backward into the third path 93. Thereafter, the second sheet SH2, the third sheet SH3 and the fourth sheet SH4 which have been conveyed through the third path 93 by the re-conveyor rollers 96 to the image forming unit 4 and have images formed on their second sides in the image forming unit 4 are guided into the first path 91 by the second flapper FL2 in the first position and conveyed and ejected out onto the output tray 21 by the second conveyor roller 95 and the first switchback roller SR1.

The controller 10 is configured such that when the second conveyor roller 95 and the first switchback roller SR1 are caused to convey a sheet S into the third path 93 in the process of duplex printing, a determination as to whether or not a sheet jam has occurred is not made. To be more specific, the controller 10 has a jam detection flag set at OFF when the second flapper FL2 is in the first position and a sheet S is turned over by using the first path 91 for duplex printing, so that the determination as to whether or not a sheet jam has occurred is not made.

On the other hand, in other situations, specifically, when a sheet S of which one side or both sides have image(s) formed thereon is ejected out using the first path 91 onto the output tray 21, or when the second flapper FL2 is in the second position and a sheet S is turned over by using the second path 92 for duplex printing, the controller 10 has a jam detection flag set at ON so that the determination as to whether or not a sheet jam has occurred is made based on the output of the detector 11.

Referring to FIGS. 6 and 7, a process of conveyance of sheets S followed when duplex printing is executed successively is described hereinbelow. Tables A, B, C, D and E show the ordinal number of the sheets S, pagination, the position of the second flapper FL2, the path into which the sheet S is guided by the second flapper FL2, action type, and jam detection flag status, for each side of the sheets S. The initial state of the jam detection flag is ON.

The controller 10 is herein configured such that a sheet S picked up from the sheet feed tray 31 is subjected earlier to printing of an image for an even-numbered page on a first side thereof and turned over, and subjected afterward to printing of an image for an odd-numbered page on a second side thereof. To be more specific, for a first sheet S, an image for the second page is printed priorly on a first side thereof, and an image for the first page is printed afterwards on a second side thereof. Similarly, for a second sheet S, an image for a fourth page is printed priorly on a first side thereof, and an image for a third page is printed afterwards on a second side thereof.

Since every sheet S is ejected with its second side down onto the output tray 21, and each sheet S ejected subsequently is stacked on a sheet ejected earlier, printing of an image for an odd-numbered page on the second side and an image for an even-numbered page on the first side facing upward allows orderly-sequenced pagination such as page 1, page 2, page 3, page 4, . . . , from below.

As shown in Table C of FIG. 6, when duplex printing is executed successively on four sheets S, the controller 10 causes a first sheet S with an image for page 2 formed on a first side thereof to be guided by the second flapper FL2 retained in the first position that is the initial position, and conveyed forward into the first path 91 and then reversed (conveyed backward into the third path 93) by the second conveyor roller 95 and the first switchback roller SR1. When this reversing action using the first path 91 is performed, the controller 10 switches the jam detection flag from its initial state, ON, to OFF. Subsequently, the controller 10 causes a second sheet S with an image for page 4 formed on a first side thereof to be guided by the second flapper FL2 retained in the first position, and conveyed forward into the first path 91 and then reversed. At this time, the controller 10 has the jam detection flag retained OFF.

Next, the controller 10 causes the second flapper FL2 to swing from the first position to the second position, and causes a third sheet S with an image for page 6 formed on a first side thereof to be guided by the second flapper FL2 in the second position, and conveyed forward into the second path 92 and then reversed (conveyed backward into the third path 93) by the second switchback roller SR2. The controller 10 switches the jam detection flag from OFF to ON after the first sheet S and the second sheet S are reversed, so that when the reversing action using the second path 92 or the ejection action using the first or second path 91, 92 are performed afterward, the jam detection flag is retained ON. Subsequently, the controller 10 causes the second flapper FL2 to swing from the second position to the first position and causes the first sheet S with an image for page 1 formed on a second side thereof to be guided by the second flapper FL2 in the first position and conveyed forward into the first path 91, and then further conveyed forward and ejected out.

Next, the controller 10 causes the second flapper FL2 to swing from the first position to the second position, and causes a fourth sheet S with an image for page 8 formed on a first side thereof to be guided by the second flapper FL2 in the second position, and conveyed forward into to the second path 92 and then reversed. The fourth sheet S picked up from the sheet feed tray 31 is fed into a conveyance path from the third path 93 to the image forming unit 4 between the preceding first sheet S to be subjected to printing of an image for page 1 (an odd-numbered page) on a second side thereof and the following second sheet S to be subjected to printing of an image for page 3 (an odd-numbered page) on a second side thereof.

Thereafter, the controller 10 causes the second flapper FL2 to swing from the second position to the first position, and causes the second sheet S with an image for page 3 formed on a second side thereof to be guided by the second flapper FL2 in the first position, and conveyed forward into the first path 91, and then further conveyed forward and ejected out. The controller 10 then causes the third sheet S with an image for page 5 formed on a second side thereof and the fourth sheet S with an image for page 7 formed on a second side thereof to be guided by the second flapper FL2 retained in the first position, and conveyed forward into the first path 91, and then further conveyed forward and ejected out.

As shown in Table D of FIG. 7, when duplex printing is executed successively on five sheets S, the controller 10 is configured to exercise, at the outset, the same control process as exercised when duplex printing is executed successively on four sheets S until the second sheet S with an image for page 3 formed on the second side thereof is guided by the second flapper FL2 positioned in the first position, and conveyed forward into the first path 91 and then further conveyed forward and ejected out.

Thereafter, the controller 10 causes the second flapper FL2 to swing from the first position to the second position and causes the fifth sheet S with an image for page 10 formed on a first side thereof to be guided by the second flapper FL2 in the second position, and conveyed forward into the second path 92 and then reversed. The fifth sheet S picked up from the sheet feed tray 31 is fed into the conveyance path from the third path 93 to the image forming unit 4 between the preceding second sheet S to be subjected to printing of an image for page 3 (odd-numbered page) on a second side thereof and the following third sheet S to be subjected to printing of an image for page 5 (an odd-numbered page) formed on a second side thereof. In this way, the fourth and subsequent sheets are fed one by one into the conveyance path from the third path 93 to the image forming unit 4 between the preceding sheet S conveyed for printing an odd-numbered page (page 1, page 3, . . . ) and the following sheet S conveyed for printing the next odd-numbered page (page 3, page 5, . . . ).

Thereafter, the controller 10 causes the second flapper FL2 to swing from the second position to the first position and causes the third sheet S with an image for page 5 formed on a second side thereof to be guided by the second flapper FL2 in the first position, and conveyed forward into the first path 91, and then further conveyed forward and ejected out. Then, the controller 10 causes the fourth sheet S with an image for page 7 formed on a second side thereof and the fifth sheet S with an image for page 9 formed on a second side thereof to be guided by the second flapper FL2 retained in the first position, and conveyed forward into the first path 91, and further conveyed forward and ejected out.

As shown in Table E of FIG. 7, when duplex printing is executed successively on six or more sheets S, the controller 10 causes the first sheet S and the second sheet S to be guided by the second flapper FL2 retained in the first position, and conveyed forward into the first path 91 and then reversed. Next, the controller 10 causes the second flapper FL2 to swing from the first position to the second position, and causes the third sheet S to be guided by the second flapper FL2 in the second position, and conveyed forward into the second path 92 and then reversed.

Thereafter, the controller 10 alternately repeats the processes of: (i) causing the second flapper FL2 to swing from the second position to the first position and causing a sheet S to be guided by the second flapper FL2 in the first position, conveyed forward into the first path 91 and then ejected out; and (ii) causing the second flapper FL2 to swing from the first position to the second position and causing a sheet S to be guided by the second flapper FL2 in the second position, conveyed forward into the second path 92 and then reversed. Next, the controller 10 causes the second flapper FL2 to swing from the second position to the first position and causes the last three sheets S ((N−2)th, (N−1)th and Nth sheets S) to be guided by the second flapper FL2 in the first position, conveyed forward into the first path 91 and then ejected out.

As shown in Table B of FIG. 6, when duplex printing is executed successively on three sheets S, the controller 10 exercises control such that only when a third sheet S with an image for page 6 formed on a first side thereof is processed, the second flapper FL2 is caused to swing from the first position to the second position so that the third sheet is conveyed forward into the second path 92 and then reversed. Otherwise, the controller 10 causes each sheet S to be guided by the second flapper FL2 in the first position, conveyed forward into the first path 91 and then reversed or ejected out.

On the other hand, when duplex printing is executed successively on two sheets S, as shown in Table A of FIG. 6, the controller 10 causes the second flapper FL2 to remain in the first position (i.e., without causing the second flapper FL2 to swing) and causes each sheet S to be guided by the second flapper FL2 in the first position, conveyed forward into the first path 91 and then reversed or ejected out.

In the illustrative, non-limiting embodiment described above, the image forming apparatus 1 operates, with advantageous effects achieved, as follows.

Since motion of the second flapper FL2 as would otherwise be required so as to reverse the second sheet S after the first sheet S is guided into the first path 91 to reverse the first sheet S is not necessitated, the second sheet S can be introduced into the first path 91 immediately after the first sheet S guided in the first path 91 is introduced into the third path 93 without waiting for the motion of the second flapper FL2. Moreover, when the third or subsequent sheets S are reversed, a sheet S to be reversed can be conveyed forward and backward in the second path 92 while a sheet S with images formed on both sides thereof can be guided into the first path 91 and ejected out of the image forming apparatus 1. Accordingly, the throughput of continuous double-sided image forming operations (duplex printing) executed successively on two or more sheets can be increased.

Since motion of the second flapper FL2 as would otherwise be required so as to reverse the second sheet S after the first sheet S is guided into the first path 91 to reverse the first sheet S is not necessitated, operation noise due to the motion of the second flapper FL2 is not produced, so that the noise caused during successively executed duplex printing operation can be reduced.

Since the second flapper FL2 in the initial state is in the first position, the necessity for the motion of the flapper FL2 as would otherwise arise when the first sheet S is reversed can be obviated. Accordingly, operation noise caused by the motion of the flapper FL2 can be avoided, with the result that the noise caused during duplex printing operation can be reduced.

Since the second flapper FL2 is configured to move from the second position to the first position by gravity, any extra means for moving the second flapper FL2 back to the first position, such as a spring for biasing the second flapper FL2 toward the first position is not necessitated. This makes it possible to reduce the number of parts of the image forming apparatus 1 and to mount the second flapper FL2 with increased ease. Moreover, electric power for moving the second flapper FL2 back to the first position that is the initial position is not necessary, which advantageously serves to save energy.

Since the second flapper FL2 is supported swingably, between the first position and the second position, on the shaft 210 as a pivot located at an upper portion of the second flapper FL2, the gravity acts as a biasing force to cause the second flapper FL2 to swing to the first position, so that the second flapper FL2 can be returned to the first position that is the initial position without fail.

The first stopper 22 which is in contact with the second flapper FL2 when the second flapper FL2 is in the second position can serve to restrain the second flapper FL2 from moving excessively. On the other hand, when the second flapper FL2 moves from the first position to the second position, the second flapper FL2 comes in contact with the first stopper 22, and would likely produce a collision noise; however, the configuration described above which serves to reduce the number of swinging motions of the second flapper FL2 can advantageously reduce the frequencies of such collisions and associated noises.

The second stopper 23 which is in contact with the actuator lever 110 when the second flapper FL2 is in the first position can serve to restrain the actuator lever 110 from moving excessively. On the other hand, when the second flapper FL2 moves from the second position to the first position, the actuator lever 110 comes in contact with the second stopper 23, and would likely produce a collision noise; however, the configuration described above which serves to reduce the number of swinging motions of the second flapper FL2 can advantageously reduce the frequencies of such collisions and associated noises.

Since a determination as to whether or not a sheet S has got jammed is not made when the sheet S is conveyed into the third path 93 by the second conveyor roller 95 and the first switchback roller SR1 during duplex printing operation, erroneous sheet jam detection in the process of duplex printing can be prevented.

The above-described embodiment may be implemented in various other forms as described below.

For example, the detector 11 may be configured to detect a sheet S which is being conveyed on a way out onto the output tray 21, and also to detect sheets S which are stacked on the output tray 21 and the number of which has reached a predetermined threshold. To be more specific, the swing lever 11A may be configured to be pushed up and kept in a swung-up position by sheets S stacked on the output tray 21 when the number of the stacked sheets S has reached a predetermined number.

With this configuration, the controller 10 may be configured such that a determination that the output tray 21 is filled to capacity for receiving ejected sheets S and thus cannot receive any more sheets S is made on condition that detection of sheet S by the detector 11 continues for a predetermined or longer duration of time. To be more specific, the controller 10 may be configured such that a determination that the output tray 21 is filled to capacity for receiving ejected sheets S and thus cannot receive any more sheets S is made on condition that the detector 11 continuously outputs an ON signal for a predetermined or longer duration of time.

In this configuration, the controller 10 may be configured such that a determination as to whether or not the output tray 21 is filled to the capacity is not made when a sheet S is conveyed into the third path 93 by the second conveyor roller 95 and the first switchback roller SR1 during duplex printing operation. More specifically, the controller 10 may be configured such that when the second flapper FL2 is positioned in the first position and the first path 91 is used to turn over a sheet S during duplex printing operation, a full-capacity detection flag is set at OFF and a determination as to whether or not the output tray 21 is filled to the capacity is not made.

With this configuration, such an erroneous determination that the output tray 21 is filled to capacity for receiving ejected sheets S and thus cannot receive any more sheets S, as would otherwise be made during duplex printing operation can be prevented.

Although the actuator lever 110 is illustrated as an example of the member configured to actuate the second flapper FL2, any other member may be feasible for this purpose. For example, the member configured to actuate the second flapper may be an electromechanical solenoid. That is, the second flapper may be configured to be actuated directly by the solenoid without any intermediate member (such as the actuator lever 110 described above) provided between the solenoid and the second flapper.

The first roller configured to convey the sheet S guided into the first path 91 forward toward the outside of the image forming apparatus 1, and backward into the third path 93 to turn over the sheet S may not be comprised of the two roller pairs (the second conveyor roller 95 pair and the first switchback roller SR1 pair). The first roller may consist of a single roller pair (e.g., only the first switchback roller SR1), or consist of three or more roller pairs. The second roller may not be comprised of one roller pair (i.e., the second switchback roller SR2) as described above, but may comprise two or more roller pairs.

The first stopper may not be, as the first stopper 22 described above, provided in a position such that when the second flapper FL2 is in the second position, the second flapper FL2 is directly in contact with the first stopper. Alternatively, the first stopper may be provided, for example, in such a position that a member configured to actuate the second flapper FL2, such as the actuator lever 110 described above, is in contact with the first stopper when the second flapper FL is in the second position. With this configuration, when the second flapper FL2 is in the second position, the first stopper serves to prevent the member configured to actuate the second flapper FL2 from moving excessively. The image forming apparatus may be configured to comprise no such first stopper.

The second stopper may not be, as the second stopper 23 described above, provided in a position such that when the second flapper FL2 is in the first position, the actuator lever 110 is in contact with the second stopper. Alternatively, the second stopper may be provided, for example, in such a position that when the second flapper FL2 is in the first position, the second flapper FL2 is directly in contact with the second stopper. With this configuration, when the second flapper FL2 is in the first position, the second stopper serves to prevent the second flapper FL2 from moving excessively. The image forming apparatus may be configured to comprise no such second stopper.

The second flapper FL2 may not be configured to swing (move) from the second position to the first position, that is the initial position, by gravity. Instead, the second flapper FL2 may be configured to swing (move) from the second position to the first position, for example, by a biasing force of a spring. The initial position of the second flapper may not be the first position, but may be the second position.

The guide member may not be configured as the second flapper FL2 to be swingable between the first position and the second position. Alternatively, the guide member may be configured to be translated or slide, frontward and rearward, or upward and downward, between the first position and the second position.

The image forming unit 4 described above is one example of feasible configurations only; for example, the image forming unit may be configured to comprise exposure units configured to expose corresponding photoconductor drums to light by using a plurality of LEDs, instead of the exposure device 5 described above. The number of process units may not necessarily be four, but may be one, two, three, five or more. In one example, where a single process unit is provided, the transfer unit 7 including the conveyor belt 73 may be omitted, and the process unit may be provided with a transfer roller. The fixing unit 8 may comprise a heating member with an endless belt, instead of the heating roller 81, and may comprise a pressure roller, instead of the pressure member 82.

The image forming apparatus may be any of a printer, multifunction machine, a copier, and the like. The above-described technical scheme may be applied not only to an electrophotographic image forming apparatus as described above, but also to an inkjet image forming apparatus.

The elements described in the above embodiment and its modified examples may be implemented selectively and in combination.

What is claimed is:

1. An image forming apparatus capable of turning over a sheet to form images on both sides of the sheet, the image forming apparatus comprising:

an image forming unit configured to form an image on a sheet;

a first path configured to guide the sheet conveyed from the image forming unit toward outside of the image forming apparatus;

a second path branching off from the first path, and configured to guide the sheet conveyed from the image forming unit;

a third path connected to the first path and the second path, and configured to guide the sheet conveyed from the first path or the second path toward the image forming unit again;

a guide member movable between a first position in which to guide the sheet conveyed from the image forming unit into the first path and a second position in which to guide the sheet conveyed from the image forming unit into the second path;

a first roller configured to convey the sheet guided into the first path forward toward the outside of the image forming apparatus, and backward into the third path to turn over the sheet;

a second roller configured to convey the sheet guided into the second path forward, and backward into the third path to turn over the sheet; and a controller, wherein when duplex printing is executed successively on three or more sheets, the controller causes a first sheet conveyed from the image forming unit and a second sheet conveyed from the image forming unit to be guided into the first path by positioning the guide member in the first position, and then conveyed into the third path by the first roller, and causes a third and subsequent sheets conveyed from the image forming unit to be guided into the second path by positioning the guide member in the second position, and then conveyed into the third path by the second roller.

2. The image forming apparatus according to claim 1, wherein the guide member in an initial state is in the first position.

3. The image forming apparatus according to claim 2, wherein the guide member is configured to move from the second position to the first position by gravity.

4. The image forming apparatus according to claim 3, wherein the guide member is supported swingably, between the first position and the second position, on a pivot located at an upper portion of the guide member.

5. The image forming apparatus according to claim 1, further comprising a first stopper with which the guide member or a member configured to actuate the guide member is in contact when the guide member is in the second position.

6. The image forming apparatus according to claim 1, further comprising second stopper with which the guide member or a member configured to actuate the guide member is in contact when the guide member is in the first position.

7. The image forming apparatus according to claim 1, further comprising:

an output tray capable of supporting one or more sheets ejected by the first roller and stacked on top of each other on the outside of the image forming apparatus; and a detector configured to detect a sheet which is being conveyed on a way out onto the output tray, and to detect sheets which are stacked on the output tray if the number of the sheets has reached a predetermined threshold, wherein the controller is configured such that:

a determination that the output tray is filled to capacity for receiving ejected sheets is made on condition that detection by the detector continues for a predetermined or longer duration of time; and a determination as to whether or not the output tray is filled to the capacity is not made when a sheet is conveyed into the third path by the first roller.

8. The image forming apparatus according to claim 1, further comprising:

an output tray configured to support a sheet ejected by the first roller to the outside of the image forming apparatus; and a detector configured to detect a sheet which is being conveyed on a way out onto the output tray, wherein the controller is configured such that:

a determination that a sheet jam has occurred is made on condition that detection by the detector continues for a predetermined or longer duration of time; and a determination as to whether or not a sheet jam has occurred is not made when a sheet is conveyed into the third path by the first roller.

9. The image forming apparatus according to claim 1, further comprising an output tray configured to support a sheet ejected by the first roller to the outside of the image forming apparatus, wherein the controller causes a sheet with an image formed on one side thereof to be guided into second path by positioning the guide member in the second position to thereby cause the sheet to be conveyed by the second roller backward into the third path, and then causes the guide member to move from the second position to the first position to thereby cause a sheet with an image formed on both sides thereof to be guided into the first path, conveyed by the first roller forward and ejected out onto the output tray.

10. The image forming apparatus according to claim 1, further comprising a housing in which the image forming unit, the first path, the second path, the third path, the guide member, the first roller, the second roller and the controller are housed, wherein the second path is located closer, than the first path, to the outside of the housing.

* * * * *